United States Patent [19]

Mitchell

[11] 3,976,479

[45] Aug. 24, 1976

[54] ALLOY SOLUTION HARDENING WITH SOLUTE PAIRS

[75] Inventor: John W. Mitchell, Charlottesville, Va.

[73] Assignee: The United States of America as represented by The United States Energy Research and Development Administration, Washington, D.C.

[22] Filed: Mar. 12, 1974

[21] Appl. No.: 450,520

[52] U.S. Cl. ..... 75/162; 75/124; 75/153; 75/173 R

[51] Int. Cl.[2] ..... C22C 9/01

[58] Field of Search ..... 75/153, 159, 162, 122, 75/123, 124, 173 R

[56] References Cited

UNITED STATES PATENTS

| | | | |
|---|---|---|---|
| 1,496,269 | 6/1924 | Iytaka | 75/159 |
| 1,916,602 | 7/1933 | Braddock | 75/162 X |
| 2,027,994 | 1/1936 | Mishima | 75/122 |
| 2,061,897 | 11/1936 | Crampton | 75/162 X |
| 2,161,574 | 6/1939 | Hensel et al. | 75/173 R |
| 3,694,273 | 9/1972 | Crane et al. | 75/153 |

FOREIGN PATENTS OR APPLICATIONS

| | | | |
|---|---|---|---|
| 257,785 | 4/1949 | Switzerland | 75/162 |
| 478,126 | 1/1938 | United Kingdom | 148/134 |

*Primary Examiner*—C. Lovell

*Attorney, Agent, or Firm*—Dean E. Carlson; David S. Zachry; John B. Hardaway, III

[57] ABSTRACT

Solution hardened alloys are formed by using at least two solutes which form associated solute pairs in the solvent metal lattice. Copper containing equal atomic percentages of aluminum and palladium is an example.

2 Claims, No Drawings

ALLOY SOLUTION HARDENING WITH SOLUTE PAIRS

BACKGROUND OF THE INVENTION

This invention was made in the course of, or under, a contract between the United States Atomic Energy Commission and the University of Virginia. It relates generally to new alloy compositions and to a method of solution hardening alloys.

The concept of solution hardening has been used in the prior art as a means of toughening alloys. In general, solute hardening produces two distinct effects. Source hardening occurs when solutes segregate at residual dislocations within subgrains and at the dislocations of subgrain boundaries. Source hardening increases the shear stress required for the nucleation of dislocation loops at the source. Solute hardening also occurs by substitutional solid solution which leads to an increase in the stress needed for the expansion and migration across the glide planes of nucleated dislocation loops.

For example, copper has been hardened by substituting zinc atoms for copper atoms in the face-centered cubic structure. This substitution increases both the yield strength and the tensile strength as compared to pure copper. Aluminum and nickel have also been used to form solution hardened copper alloys.

While such methods of solution hardening have greatly improved the mechanical properties of metals and alloys, the chemical properties are somewhat adversely affected thereby or at least not improved. The problems of corrosion and stress corrosion, for example, are generally more severe for solution hardened alloys than for the pure metal. Irradiation resistance also is generally not improved by conventional solution hardening.

SUMMARY OF THE INVENTION

It is thus an object of this invention to provide a new method of solution hardening.

It is a further object of this invention to provide a method of solution hardening which not only improves the mechanical properties but also improves the resistances to corrosion and stress corrosion.

It is thus a still further object of this invention to provide new alloy systems which are produced by the method of this invention.

These as well as other objects are accomplished by forming a solution hardened ternary or quaternary alloy in which solutes which form solute pairs in the solvent metal lattice are used as the hardening agent.

DETAILED DESCRIPTION

According to this invention it has been found that the addition of solutes which will form solute pairs within the base metal lattice synergistically improves the mechanical properties as compared to the same solvent metal with the single solutes present in the same total atomic amount.

The principle of solute pair hardening is based upon the following non-limiting theory: (1) Shear stresses which have to be established for the operation of sources involving residual dislocations at subgrains or at subgrain boundaries are increased compared with other binary, ternary and quaternary alloys by the separation of a paired solute phase within the two planes of atoms on either side of stacking faults of dissociated dislocations; and (2) a high density of paired solute atoms appears throughout the grains during cooling from the melting point or the annealing temperature to room temperature. The mechanism postulated in the first instance contributes to dislocation source hardening, and in the second to an increase in the flow stress, compared with the binary alloys with an equal total concentration of solute atoms.

In general, several conditions must be met for the solute pair hardening of this invention to occur. The individual solutes must form a substitutional solid solution with the solvent metal and their concentrations must be less than those which would produce a phase change or the formation of two phases. As another condition, in the ternary alloys, the two solutes must associate to form pairs of clusters of very few pairs rather than discrete precipitates. In the quaternary alloys one of the solutes must form such pairs or clusters with each of the two remaining solutes. These two remaining solutes need themselves not form such pairs. This condition is met when the binary alloys of the solutes involved in pair formation show a melting point maximum with congruent melting at the 50 atomic percent composition. The majority of suitable binary alloys with this property have the CsCl structure at least near the melting point. The melting point maximum at the 50 atomic percent composition is a good indication of the free energy decrease on formation of the alloy with the higher melting point indicating the greater free energy decrease. It is preferred that the melting point of the binary alloy should be significantly greater than that of the solvent metal. This arises from the fact that for pair formation to be energetically favorable, the lowering of the free energy for the solute pairs surrounded by solvent atoms must be greater than for each solute separately, surrounded by the solvent metal atoms. Since the entropy is decreased by association, the enthalpy must be substantially decreased to give an effective overall decrease in the free energy. One further condition is important in determining the properties of these alloys. It can be defined quantitatively by the ratio of the interatomic distance in the solvent metal to the interatomic distance in the binary alloy with the CsCl structure. When the ratio is near unity, there is a small change in lattice parameter with solute concentration and the internal strain around the solute pairs is small, but substantial solute hardening occurs. This demonstrates that a substantial fraction of the solute hardening in the alloys covered by this invention arises from the operation of a novel mechanism, namely, the work which would have to be done to separate the exothermally formed solute pairs with interatomic axes intersecting the glide planes. Since these energies of chemical origin are large compared with elastic strain energy, a particularly effective mechanism for solute hardening is made available in which the hardening is substantially greater for the ternary and quaternary alloys than for the binary alloys between the solvent and the individual solutes of the same total atomic concentration. This results in a significant extension of the elastic range. The solute pairs may expand, leave unchanged, or contract the lattice of the solvent metal. To minimize chemical reactivity, the change should be as small as possible.

The novel alloys produced in accordance with this invention in addition to other superior properties are expected to exhibit substantially improved resistance to irradiation. Radiation damage depends on the production of lattice disorder at relatively large distances from the tracks of the primary and secondary recoil atoms. The mechanism believed to be responsible involves momentum transfer through focused collision sequences along close packed rows of atoms radiating outwards from atoms struck by the primary and secondary recoil atoms. Atoms are then displaced from the close packed rows into interstitial positions at considerable distances from the sites of initiation of the collision sequence. The range of these focused collision sequences is greatly reduced and energy dissipation increased by substituting atoms which are lighter and heavier than the solvent atoms along the close packed rows particularly if these atoms are bonded to other atoms in adjacent rows. The result of this is an increase in the local density of displacement processes and a local increase in temperature. The scattering processes introduced as a result of the mismatch between the masses of the solute and solvent atoms leads to the conversion of a momentum pulse into a cloud of phonons reducing the range of the pulse and the efficiency with which interstitials are produced. Both the higher density because of the shorter range and the increased temperature favor recombination processes and reduce the extent of permanent radiation damage at the temperature of irradiation. Pairs of atoms consisting of one atom lighter and one atom heavier than the solvent atoms will be particularly effective in reducing the incidence of radiation damage. Recombination is also facilitated when the interatomic distance in the solute pairs is greater or less than the interatomic distance in the solvent metal. In this case compressive or dilatational axial stress fields develop so that the pairs act as recombination centers for the point defects produced by irradiation. The rate of development of supersaturations in interstitials and vacancies which are necessary for dislocation loop and void formation are thus reduced.

Four binary alloys have been found which exhibit a melting point maximum at the 50 atomic percent composition. These may be used in suitable solvent metals in the application of this invention. These alloys with their melting points and interatomic distances are listed in Table I, together with the solvents copper, silver, and iron in Table II.

TABLE I

| Solute Pair | Melting Point Max. at 50 atomic % | Interatomic Distance |
|---|---|---|
| Al,Co | 1645°C | 2.479 A |
| Al,Ni | 1638°C | 2.500 A |
| Al,Pd | 1645°C | 2.629 A |
| Mg,Au | 1150°C | 2.828 A |

TABLE II

| Solvent | Melting Point Max. at 50 atomic % | Interatomic Distance |
|---|---|---|
| Cu | 1083°C | 2.556 A |
| Ag | 960.5°C | 2.889 A |
| Fe | 1534°C | 2.482 A |

The following ternary and quaternary alloys thus fall within the scope of this invention: Cu-Al-Ni, Cu-Al-Pd, Cu-Al-(Ni,Pd), Ag-Al-Pd, Ag-Mg-Au, Fe-Al-Co, Fe-Al-Ni, Fe-Al-Pd, Fe-Al-(Co,Ni), and Fe-Al-(Ni,Pd). The bracketed pairs in the quaternary alloys form binary alloys with a complete range of solid solutions.

Their combined solute concentration is equal to that of the aluminum. The use of a pair, (Ni,Pd), or (Co,Ni) allows partial compensation of lattice parameter changes. In the case of the (Ni,Pd) pair, it allows the anti-corrosion and anti-stress corrosion action of palladium to be achieved with a lower concentration while maintaining the tensile strength of the alloy. The range of equiatomic percentage concentrations for the solutes extends from low concentrations, e.g., 0.5 atom percent, to the composition at which there is a phase change or a new phase appears which can be detected by the appearance of a characteristic X-ray or electron diffraction pattern.

While it is, of course, preferred to have the solutes in equal atomic concentrations since this composition is the most likely to result in complete pair formation, it is understood that it is not necessary for the concentrations to be equal in order for the beneficial effects of this invention to be achieved. The solutes must, of course, be within the above-cited ranges in order to prevent a phase change or the appearance of new phase, but as long as the solutes are within the above-cited ranges a certain amount of pair formation will result and the beneficial effect of this invention achieved.

One particular alloy of the above-listed alloys has shown remarkable properties, above and beyond those expected from the novel theory previously presented. This particular alloy, copper with equal atomic percentages of aluminum and palladium, has shown unprecedented and unexpected resistance to corrosion and stress corrosion as well as possessing the superior mechanical properties created by the process of this invention. The resistance to local corrosion at dislocations has been so great that no method of satisfactorily etching them has been found.

In view of the properties of the copper-aluminum-palladium alloy, the following specific examples are given with particular reference to this alloy system.

EXAMPLE I

The ternary Cu-Al-Pd alloys with equiatomic % solute concentrations up to 6% were produced by first making Cu-Al and Cu-Pd alloys with the required overall compositions separately and then melting them together. If the attempt is made to melt the three components together, the binary Al-Pd alloy melting at 1645°C appears to be formed exothermally. It dissolves in molten copper at temperatures within a 100° of the melting point at a very slow rate. The components were melted in graphite molds at a pressure of $10^{-7}$ Torr which was maintained with a high capacity ion pump. The molds were heated inside a quartz envelope with high frequency currents. The alloys were produced in the form of cylindrical rods 6 inches long and 0.5 inch in diameter. In all cases, these rods were re-melted at least once and the molten alloy was run through a capillary from the melting to the casting section of the mold to ensure effective mixing. Alloys of 1, 2, 3, 4, and 6 equal atomic percents were prepared in this manner.

EXAMPLE II

Square-sectioned single crystals (4.5 × 4.5 mm) with the $[\bar{1}2\bar{5}]$ $\{1\bar{2}\bar{1}\}$ $\{\bar{2}\bar{1}0\}$ orientation were grown in split graphite molds using accurately oriented seed crystals with the same composition. The seed section was separated from the growth section by two lineage filters. New molds were baked out at a pressure of $10^{-6}$ Torr for many hours and then filled with charge of a copper-aluminum alloy and heated above the melting point of the alloy in a resistance furnace in an atmosphere of high purity argon. This procedure, which can be repeated as often as required, leaches impurities from the graphite without spoiling the highly polished inner surfaces of the molds. Before the growth of any crystal, these surfaces were carefully polished and then covered with a thin deposit of carbon from a methane flame. This reduces friction between the crystal and the surfaces of the mold and improves the qulity of the as-grown crystals. The crystals were grown at a pressure of $10^{-7}$ Torr maintained with large capacity ion pump. The molds were stationary on the axis of fused quartz envelope and the growth front was moved upwards at a constant rate by moving the high frequency coil used for heating.

The seed crystals were produced by initial crystallization on accurately oriented $[\bar{1}2\bar{5}]$ $\{1\bar{2}\bar{1}\}$ $\{\bar{2}\bar{1}0\}$ Cu-Al seed crystals with the same at% concentration Al as in the ternary alloy. The orientation of the resulting ternary alloy single crystal was then corrected crystal spark planing and a new crystal was grown on this seed. Crystals with 1, 2, 3, and 4 equiatomic percent aluminum and palladium were grown in this manner. This procedure was usually repeated several times to produce a number of seed crystals of the required composition and orientation. Emphasis was placed on achieving the highest possible accuracy for the orientation of an adjacent pair of $\{1\bar{2}\bar{1}\}$ and $\{\bar{2}\bar{1}0\}$ surfaces as the line of intersection of these two plane surfaces defines the axis of the crystal. The two plane surfaces were held firmly against the surfaces of the graphite mold with graphite wedge, and a crystal was grown on the seed. This was cut to provide further seeds with the full square cross-section and, if necessary, the orientation was improved by repeating the same procedures.

Both the alloy casts and the single crystals were annealed for at least 100 hours in graphite molds in an atmosphere of high purity argon at a pressure of about 790 Torr. A high thermal capacity resistance furnace was used and the temperature was maintained constant within better than ±0.1°C at a steady state temperature within 50°C of the melting point of the alloy. This was done by using a constant voltage transformer for the power supply and determining the power input with an auto-transformer.

EXAMPLE III

Polycrystalline bars with a square section (4.5 × 4.5 mm) were produced by rolling the 0.5-inch-diameter annealed casts with a heavy-duty rolling mill through the successive channels of a pair of grooved rolls. Alloys of 1, 2, 3, and 4 equiatomic percent aluminum and palladium were used. The ternary alloys were remarkably ductile, considering their tensile strength. Straight smooth surface bars completely free from surface or internal flaws or fractures were produced with a reduction of area of 84% without any need for intermediate annealing. Further tests showed that a reduction of area of 96% could be achieved without annealing.

To produce recovery and grain growth, the rolled bars were heated for varying times in an argon atmosphere in the resistance furnace at temperatures between 800° and about 100°C below the melting point. They were then cooled slowly to room temperature.

EXAMPLE IV

Attempts were made to polish samples produced in the above examples. The methods for chemical and electrochemical polishing developed for producing optical flats on single crystals of Cu and α-phase Cu-Al, Cu-Al-Ni, and Cu-Ni alloys cannot be used with Cu-Pd and Cu-Al-Pd alloys. When these alloys are treated with most acid etching and polishing solutions, a thin black film of palladium forms on the surfaces which reduces the rate of dissolution. This film is removed by a solution of hydrogen peroxide in ammonia containing ammonium acetate which also etches the surfaces and reveals grain structure in polycrystalline specimens.

It was necessary to produce plane surfaces by mechanical polishing methods. Plane optically polished surfaces were produced on all four sides of the crystals by polishing on fine cotton laps stretched over plate glass with graded α- and γ-alumina powders suspended in polyethylene glycol-400. It was not possible to use this procedure for the much softer Cu, Cu-Al, Cu-Ni, and Cu-Al-Ni single crystals. Phosphoric acid polishing baths can also not be used for the Cu-Pd and Cu-Al-Pd alloys since a black palladium film is immediately formed on the surfaces. The crystals were then cleaned and electropolished, to remove any mechanical damage, in a bath with the following composition:

| | |
|---|---|
| Polyethylene glycol-600 | 40 ml |
| Polyethylene glycol-1000 | 20 ml |
| Perchloric acid-70 mol% | 60 ml |

The perchloric acid was added to the mixed glycols very slowly with cooling and stirring. It was found that this bath also produces a very good finish on α-phase ternary Cu-Al-Ni alloys with compositions approaching the α-phase boundary. The specimens were electropolished in a 1.5-inch-diameter cell with a thin stainless steel cylindrical sheet cathode at a current density of 0.05 amp $cm^{-2}$ with 12 volts across the cell. It was not possible to produce ultramicroscopically smooth surfaces on single crystals of these alloys of the same quality as on binary and ternary alloys of the Cu-Al-Ni system. The electropolishing bath left a thin film of colloidal palladium on the surfaces most of which could be washed off with distilled water, leaving surfaces which were optically flat and mirror smooth from the point of view of optical interference microscopy. They were not smooth from the point of view of replica electron microscopy, and high resolution studies of slip terrace structures cannot be made with them.

The surfaces produced on the Cu-Al-Pd alloys showed a high resistance to atmospheric corrosion and to attack by dilute acids, alkalis, and salt solutions. Deformed single crystals were not selectively attacked in regions of high dislocation density by reagents which etch dislocations emerging at the surfaces of Cu, Cu-Al, Cu-Ni, and Cu-Al-Ni single crystals, with selective attack at dislocations decreasing in this order. It is therefore expected that the ternary Cu-Al-Pd alloys would have a much higher resistance to stress corrosion than these other alloys. No method for selectively etching {111} or other surfaces at the points of emergence of dislocations was found.

Optical flats were produced on the four surfaces of the polycrystalline bars by the mechanical polishing methods described above. The surfaces were then electropolished by the same method.

EXAMPLE V

The precise orientations of the $\{1\bar{2}1\}$ and $\{\bar{2}10\}$ surfaces of the single crystals were determined with X-ray Laue and divergent beam back-reflection diffraction patterns. Both methods showed that good quality single crystals could be grown with up to at least 4-equiatomic % Al and Pd. Debye-Scherrer X-ray powder diffraction patterns showed that the lattice parameter increases with solute concentration up to 2-equiatomic % Al and Pd and then remains constant with a mean value of 3.622 A compared with 3.615 A for pure copper. The 4-equiatomic percent alloy showed no diffraction lines indicating the presence of a second phase. The 6-equiatomic percent alloy showed the characteristic diffraction lines of the Al-Pd cesium chloride structure so that the boundary for the discrete separation of this phase lies between 4 and 6-equiatomic percent.

As used within this disclosure, the phase boundary is defined by the solute concentration at which characteristic lines of the second phase can be detected by X-ray or electron diffraction methods. The constancy of the lattice parameter is attributed to the separation of solute pairs which do not produce a significant expansion of the lattice parameter. The solute pairs and small clusters of pairs do not constitute a second phase in the generally accepted sense of the term. This is also illustrated by the lattice parameters of three Cu-x-equiatomic%-Al-Ni alloys which have been studied. For $x = 0$, $a = 3.6147$; $x = 2$, $a = 3.6175$ A; and for $x = 4$, $a = 3.6194$ A. The lattice parameters of the alloys are only slightly greater than the parameter for copper showing the compensation by pair formation which would be anticipated from comparison of the interatomic distance of 2.500 A in the Al-50 at% Ni alloy and the interatomic distance of 2.556 in copper.

The quality of the ternary alloy single crystals with up to 4-equiatomic%-Al-Pd and up to 4-equiatomic%-Al-Ni was also confirmed by the appearance of clusters of straight continuous uniformly spaced slip lines which are observed to run from edge to edge on the $\{\bar{2}10\}$ surfaces of the square sectioned crystals after deformation by a uniaxial tensile stress.

The grain structure of the polycrystalline bars as-rolled and after recovery and grain growth anneals was determined by metallographic etching with ammonical hydrogen peroxide solutions and with X-ray back-reflection diffraction patterns taken with Cu-K$_\alpha$ radiation.

EXAMPLE VI

The first crystal of Cu-Al-Pd alloy mounted with "Cerromatrix" alloy in the grips of the tensile system pulled out of the grips below the yield point at 4.2°K, behavior never experienced with Cu or Cu-Al, Cu-Ni, or Cu-Al-Ni alloys. The cause was traced to a very thin residual film of palladium which prevented adhesion between the "Cerromatrix" alloy and the surface of the crystal. The problem was completely eliminated by placing 5 to 10 microns of nickel followed by 5 to 10 microns of copper onto the ends of the crystals before mounting. The polycrystalline bars, which were deformed only at room temperature, were held in standard "Instron" tensile grips.

EXAMPLE VII

The tensile system used for the study of the mechanical behavior of the single crystals at 4.2°K was the same as that described in *Physical Review*, Vol. 9, 1974, by Schwarz and Mitchell. The load was determined with a ceramic piezoelectric transducer mounted in the lower universal head of the tensile system. This was calibrated against a standard proving ring which was itself calibrated with a set of standard weights.

The crystals were elongated at a constant machine rate of 0.05 cm min$^{-1}$ to just below the yield point. The rate was then changed to 0.005 cm min$^{-1}$ and the yield point determined in two successive experiments. The load scale was then expanded and the rate further reduced to 0.001 cm min$^{-1}$ for the study of serrated yielding and the determination of the maximum load which the crystal would sustain.

The yield load of the Cu-4-equiatomic%-Al-Pd crystals exceeded the design limit of the low-temperature tensile system. These crystals were clamped in serrated grips of the universal heads of an "Instron" tensile machine and load-elongation curves were recorded at room temperature with the "Instron" load cell (5000 kg maximum load) and the "Instron" chart recording system. The yield stress was determined at a machine rate of 0.05 cm min$^{-1}$, and segments of the load-elongation curves beyond the yield point were then recorded with an expanded load scale at a machine rate of 0.005 cm min$^{-1}$.

The as-rolled and annealed polycrystalline specimens were mounted in the serrated grips of the "Instron" system and deformed at room temperature with the same system as the Cu-4-equiatomic%-Al-Pd single crystals at a strain rate of 0.05 cm min$^{-1}$. The results are recorded in Table III below.

TABLE III

| Composition Equiatomic% Al-Pd | Yield Stress Kg mm$^{-2}$ | Average Rate of Work Hardening Kg cm$^{-1}$ |
|---|---|---|
| As-rolled with recovery at room temperature. | | |
| 1.0 | 29 | $1.75 \times 10^3$ |
| 2.5 | 35 | $1.43 \times 10^3$ |
| 4.0 | 32 | $1.25 \times 10^3$ |
| Fully annealed specimens | | |
| 1.0 | 4.3 | $7.5 \times 10^2$ |
| 2.5 | 12.5 | $5.5 \times 10^2$ |
| 4.0 | 22 | $6.0 \times 10^2$ |

EXAMPLE VIII

The high ductility of the Cu-2 to 4-equiatomic%-Al-Pd alloys was demonstrated by the experience that the 0.5-inch-diameter cast and annealed cylindrical rods could be reduced in area by 85 to 95% without intermediate annealing to produce sound material of round or square cross section without microscopic flaws or cracks. This is an unusual property for an alloy system with the measured tensile yield strength. It is attributed to the presence of the solutes as distribution of solute pairs which are broken up and reformed during plastic deformation.

EXAMPLE IX

On annealing for periods of more than 100 hours at temperatures within 100°C of the melting point, alloys of Cu-1, 2, 3, and 4 equiatomic % Al-Pd composition slowly developed an equiaxed grain structure with a high density of annealing twins which is characteristic of the α-phase Cu-Zn, Cu-Al, Cu-Si, and Cu-Ge alloy systems. The grains of the annealed polycrystalline structure grew at an extremely slow rate and did not develop plane intergranular boundaries which would give linear segments in plane section.

These observations are indicative of low climb rate for dislocations with an edge component. They also suggest that the alloys would show significant resistance to creep and recovery at relatively high temperatures.

EXAMPLE X

The corrosion resistance of single crystals and of as-rolled and annealed polycrystalline bars of alloys of Cu-1, 2, 3 and 4 equiatomic % Al-Pd composition was established by immersing them for a period of three months in a saturated solution of sodium chloride, together with single crystals and bars of pure copper and as-rolled and annealed polycrystalline specimens of α-phase Cu-Al alloys. The copper and the Cu-Al alloys were extensively attacked. The ternary alloys were only blackened by the salt solution due to the development of a surface film of palladium. This film appeared to protect them from further attack and they showed unusual resistance to corrosion with salt solutions for a copper alloy. Surface scratches which exposed the underlying alloy also rapidly developed a corrosion resistant surface film of palladium. This self-healing property of the surface is a particularly valuble feature of the palladium alloys covered by this invention.

They were also resistant to tarnishing and atmospheric corrosion. Optical flats with a mirror finish have not tarnished over a period of many months. This is in striking contrast to optical flats on pure copper and even on α-phase Cu-Al alloys. It is clear that resistance to tarnishing and corrosion is conferred by the addition of a relatively small atomic % of palladium to a Cu-Al alloy.

EXAMPLE XI

Compositions of Cu-1, 2, 3, and 4 equiatomic % Al-Pd were tested for stress corrosion resistance. No change was observed in the rate of dissolution of single crystals and of annealed polycrystalline bars of the alloys as a result of plastic elongation as compared to that of the non-deformed alloys. All the specimens were blackened in corrosive solutions of hydrochloric acid saturated with cupric chloride, ferric chloride and dilute nitric acid with the formation of a film of palladium which reduced the rate of continuing corrosive attack to a very low value.

Single crystals with the $[\bar{1}2\bar{5}]$ $\{1\bar{2}\bar{1}\}$ and $\{\bar{2}\bar{1}0\}$ orientation were not preferentially attacked within the narrow slip bands which were introduced by local plastic deformation at 4.2°K and at higher temperatures. There was far higher density of dislocations here than in the surrounding undeformed volumes of the crystal. With the α-phase Cu-Zn and Cu-Al alloys, which have a low resistance of stress corrosion, the areas with a high density of dislocations where the bands intersect the surface were attacked at a far greater rate than the surrounding areas by solutions of cupric chloride and ferric chloride containing hydrochloric acid. This resulted in the formation of deep groove at the slip band. When the α-phase binary alloy crystals apart from the Cu-Pd alloys with polished surfaces were immersed for a short time in a corrosive solution of ferric chloride containing hydrobromic and hydrochloric acid, local pits were formed at the points of intersection of the dislocations with the surface. This is the basis of the etching method for establishing the densities and distributions of dislocations in plastically deformed single crystals of metals and alloys. A strong correlation has been found between local attack at dislocations and at local areas of high dislocation density by corrosive solutions and susceptibility to stress corrosion. For the ternary Cu-x-equiatomic%-Al-Pd alloys, no chemical reagent has yet been found which will produce grooves along the intersections of the narrow slip bands with the surfaces or produce local etch pits at dislocations intersecting the surfaces. Most corrosive solutions blacken a highly polished surface immediately on immersion and the rate of subsequent attack is controlled by the palladium film which is developed. There has never been selective attack in areas of high dislocation density or selective attack at dislocations. The alloys are attacked without blackening by strong solutions of hydrogen peroxide in ammonia containing ammonium acetate, but there is again no selective attack in regions of high dislocation density.

These observations suggest that the ternary Cu-Al-Pd alloys show a high level of stress corrosion resistance.

EXAMPLE XII

X-ray back-reflection diffraction patterns were taken with Cu-K$_\alpha$ radiation for the as-rolled and annealed polycrystalline bars. The patterns showed that the as-rolled bars after 85% reduction in area had a grain size of the order of $10^{-4}$ cm in agreement with the metallographic observations. There was no evidence for the development of a rolling texture. Recrystallization with grain growth was shown to occur at a very slow rate below 850°C in striking contrast with other copper alloys with the same solute concentration. Reasonably rapid recrystallization occurred above 950°C but, as already noted from the metallographic work, equiaxed grains did not deveop. The diffraction spots from the individual grains were, however, sharply defined showing that the lattice strains have been removed.

EXAMPLE XIII

A series of X-ray powder diffraction patterns were taken with a "Unicam" 19-cm camera and Cu-K$_\alpha$ radiation. The lattice parameter increased for the Cu-1 and 2-equiatomic%-Al-Pd compositions and thereafter the mean value remained constant to the 6-equiatomic percent alloy which is beyond the boundary of the homogeneous α-phase. The significance of these observations has been discussed in Example V. The lattice parameters of the alloys are given in Table IV below as a function of the nominal composition.

TABLE IV

Lattice Parameters

| Composition Equiatomic Concentration | Lattice Parameter A |
|---|---|
| 0.0 | 3.6147 |
| 1.0 | 3.6211 |
| 2.0 | 3.6221 |
| 3.0 | 3.6224 |
| 4.0 | 3.6198 |
| 6.0 | 3.6255 |

The quality of the single crystals of the Cu-x-equiatomic%-Al-Pd alloys, where $x$ was 1, 2, 3, and 4, was non-destructively determined with pseudo-Kossel line back-reflection X-ray diffraction patterns taken with Cu-$K_\alpha$ radiation. The high resolution possible on account of the sharp definition of the arcs establishes the absence of any substructure with subgrain misorientations greater than 20 minutes of arc. It was not possible to reveal the location of the subgrain boundaries by preferential etching methods so that the dimensions of subgrains with smaller angular misorientations have not been established. The conclusion reached as a result of these studies is that the single crystals have remarkable level of perfection in relation to their relatively high critical resolved shear stress at the yield point. It has not been possible to achieve this balance between perfection and yield stress with the binary Cu-Al system.

EXAMPLE XIV

Load-elongation curves for polycrystalline bars of the alloys as-rolled (84% reduction in area) and after annealing for different periods of 100°C below the melting point have been recorded at room temperature with a 5000 kg "Instron" load cell and an "Instron" chart recording system. The tensile stress at the elastic limit is given in Table III, together with the rate of strain hardening above the elastic limit.

The as-rolled and annealed polycrystalline bars have a high tensile stress at the elastic limit compared with pure binary copper alloys apart from precipitation-hardened alloys such as Cu-Be alloys. Above the yield point, they show a higher rate of strain hardening than polycrystalline binary Cu-3 to 14 at%-Al alloys. The tensile stress at the yield point of as-rolled polycrystalline bars of the ternary Cu-Al-Pd alloys was not reduced by long periods of annealing to the same extent as that of similar bars of Cu-Al alloys. These properties are indicative of greater resistance to slow creep under tensile loads at elevated temperatures than the binary copper alloys.

EXAMPLE XV

Load-elongation curves showing the transition from the elastic to the plastic range at 4.2°K were made. At least two crystals were deformed for each composition and good reproducibility was achieved. The critical resolved shear stress at the yield point is given as a function of composition in Table V below and Table VI is included for comparison with copper-aluminum binary alloys. The critical resolved shear stress is a linear function of $x$, the equiatomic%-Al-Pd solute concentrations between $x = ½$ and 3 percent. Curves for the smaller values of $x$ show a curving away from the linear elastic range immediately before the occurrence of the first abrupt elongations. For the alloys with the larger values of $x$, the elastic range is abruptly terminated by the first abrupt elongation.

TABLE V

The Critical Resolved Shear Stress as A Function of Composition for the {111} [101] Glide System at 4.2°K

| Composition Equiatomic% Al-Pd | C.R.S.S. in Kg mm$^{-2}$ |
|---|---|
| 0.1 | 2.05 |
| 1.0 | 3.29 |
| 2.0 | 5.13 |
| 2.5 | 6.61 |
| 3.0 | 7.39 |

TABLE VI

For α-phase Cu-Al binary alloys at 4.2°K

| Solute concentration Atomic %-Al | C.R.S.S. Kg mm$^{-2}$ |
|---|---|
| 2.0 | 1.25 (1) |
| 4.0 | 2.12 (2) |
| 10.5 | 3.12 |

(1) can be compared with the 1-equiatomic % Al-Pd alloy.
(2) can be compared with the 2-equiatomic % Al-Pd alloy.

EXAMPLE XVI

Characteristic serrated load-elongation curves beyond the yield point for single crystals with the different compositions were made. For alloys with the lower solute concentrations, e.g., $x = 1$, steady elongation at an increasing load level occurred above the yield point. Superimposed on the steady elongation were successive abrupt elongations which were followed by an elastic recovery segment to the load at which the steady elongation was resumed. This shows that both a stable and an unstable plastic deformation regime is possible with these alloys. The steady increase in the load with increasing elongation does not occur for the single crystals with the larger solute concentrations, e.g., $x =$ 2 and 3. The abrupt elongations were initiated from a very nearly constant load level and were followed by elastic recovery to the same load level, sometimes small segments of elongation at nearly constant load, and then further abrupt elongations.

From the above examples, the copper, aluminum, palladium alloys are expected to show high degree of resistance to neutron irradiation. Vacancies formed by irradiation should be attracted to Al-Pd solute pairs and there combine with interstitials so that a supersaturation of neither vacancies nor interstitials should develop. The presence of Al-Pd pairs would thus catalyze the recombination of vacancies and interstitials produced by irradiation. This source o irradiation resistance should be even more operative in Fe-Al-Ni, Fe-Al-Pd, and Fe-Al-(Ni,Pd) alloys where there is a larger axial compressive stress field with tetragonal symmetry associated with the solute pairs.

As should be apparent from the above description and examples the alloys of this invention may be used in marine systems, atomic energy desalination reactors for piping hot and cold saline solutions, and in boilers for saline solutions to which they show a remarkable resistance to corrosion and stress corrosion.

What is claimed is:

1. A single phase alloy composition consisting essentially of a copper solvent metal and two solutes, said solutes existing as associated pairs within said solvent metal, said solutes being aluminum and palladium in percentages within the range of 1 to 4 atom percent.

2. The alloy of claim 1 wherein said aluminum and palladium are present in equal percentages.

* * * * *